US008801506B2

(12) United States Patent
Chen

(10) Patent No.: US 8,801,506 B2
(45) Date of Patent: Aug. 12, 2014

(54) DUST COLLECTION HOOD FOR GRINDING MACHINE TOOLS

(75) Inventor: Bach Pangho Chen, Claremont, CA (US)

(73) Assignee: X'Pole Precision Tools Inc., Zhongli, Taoyuan County (TW)

( * ) Notice: Subject to any disclaimer, the term of this patent is extended or adjusted under 35 U.S.C. 154(b) by 242 days.

(21) Appl. No.: 13/305,165

(22) Filed: Nov. 28, 2011

(65) Prior Publication Data

US 2013/0137348 A1 May 30, 2013

(51) Int. Cl.
*B24B 55/10* (2006.01)
*B24B 55/06* (2006.01)

(52) U.S. Cl.
CPC ..... *B24B 55/06* (2013.01); *B24B 55/102* (2013.01)
USPC ..... 451/453; 451/456; 451/359

(58) Field of Classification Search
CPC .... B24B 26/0076; B24B 55/06; B24B 55/10; B24B 55/102; B24B 55/105
USPC ..... 451/453, 344, 353, 359, 451, 456
See application file for complete search history.

(56) References Cited

U.S. PATENT DOCUMENTS 3,522,679 A * 8/1970 Sundberg ..... 451/36
3,594,958 A * 7/1971 Cusumano ..... 451/358
3,722,147 A * 3/1973 Brenner ..... 451/359
3,862,521 A * 1/1975 Isaksson ..... 451/456
D256,881 S * 9/1980 Hutchins ..... D8/62
4,328,645 A * 5/1982 Sauer ..... 451/359
5,125,190 A * 6/1992 Buser et al. ..... 451/456
5,403,231 A * 4/1995 Duckworth ..... 451/344
5,411,433 A * 5/1995 Keller ..... 451/451
5,791,979 A * 8/1998 Duncan et al. ..... 451/456
6,053,806 A * 4/2000 Ohlendorf ..... 451/456
6,758,731 B2 * 7/2004 Dutterer et al. ..... 451/357
7,497,886 B2 * 3/2009 Walker ..... 55/385.1
2005/0202769 A1 9/2005 Chang
2008/0171501 A1 * 7/2008 Woods et al. ..... 451/451

* cited by examiner

*Primary Examiner* — Lee D Wilson
*Assistant Examiner* — Tyrone V Hall, Jr.
(74) *Attorney, Agent, or Firm* — Muncy, Geissler, Olds & Lowe, P.C.

(57) ABSTRACT

A dust collection hood installed on a grinding machine tool which includes a driving motor and at least one grinding portion driven by the driving motor to rotate. The dust collection hood includes a circumferential wall surrounding the grinding portion and a dust collection cap. The dust collection cap is coupled with the circumferential wall to form a dust collection chamber to house the grinding portion, and includes a top fastened to the grinding machine tool. The dust collection chamber is formed at a height gradually decreased from the top towards the circumferential wall. The dust collection cap further includes a dust discharge port communicating with the dust collection chamber and an airflow guiding portion to guide airflow from the dust collection chamber to the dust discharge port. Thus a great amount of dust generated during grinding can be discharged via the dust discharge port.

16 Claims, 6 Drawing Sheets

DUST COLLECTION HOOD FOR GRINDING MACHINE TOOLS

FIELD OF THE INVENTION

The present invention relates to a dust collection hood and particularly to a dust collection hood to expel a large amount of dust.

BACKGROUND OF THE INVENTION

During surface grinding, a machine tool which commonly includes an electric motor and a grinding disc is usually used. The grinding disc holds mating sandpaper at the bottom thereof. The electric motor drives the grinding disc rotating at a high speed to allow the sandpaper to grind the surface of a targeted object.

During grinding at high speed, dust is generated. Hence the machine tool usually has a hood located above the grinding disc to connect to a suction device to expel the generated dust. For instance, U.S. publication No. 2005/0202769 discloses an improved grinding disc for grinders. It has the grinding disc coupled with a dust suction hood, and an outer wall to form a contact surface with a plurality of axial air vents and a plurality of radial air vents communicating with the axial air vents. The grinding disc is held in a housing chamber of the tool body. The housing chamber has a driving shaft fastened by a fastening portion of the grinding disc. The driving shaft drives the grinding disc to perform grinding operation. Debris and dust generated during the grinding operation are quickly sucked by the air vents on the grinding disc surface and expelled.

However, when the aforesaid machine tool performs larger surface grinding (such as tabletop, wall surface, ground surface and the like), a great amount of dust is generated during high speed grinding. The aforesaid air vents do not have sufficient dust expelling capacity to expel so large amount of dust. A large-scale dust suction apparatus has to be used to suck away the dust, and the air vents could even be possibly clogged. There is still room for improvement.

SUMMARY OF THE INVENTION

The primary object of the present invention is to solve the problem that a great amount of dust generated during grinding at high speed or large area cannot be immediately expelled.

To achieve the foregoing object the present invention provides a dust collection hood for grinding machine tools to be installed on a grinding machine tool. The grinding machine tool includes a driving motor and at least one grinding portion driven by the driving motor to rotate. The dust collection hood includes a circumferential wall surrounding the grinding portion and a dust collection cap. The dust collection cap is coupled with the circumferential wall to form a dust collection chamber to house the grinding portion. The dust collection cap includes a top fastened to the grinding machine tool. The dust collection chamber is formed at a height gradually decreased from the top towards the circumferential wall. The dust collection cap further includes a dust discharge port communicating with the dust collection chamber and an airflow guiding portion to guide airflow from the dust collection chamber to the dust discharge port.

In one aspect the grinding machine tool includes a plurality of grinding portions at the same horizontal level.

In another aspect the grinding machine tool includes an air fan located between the grinding portion and dust collection cap and coupled with the driving motor.

In yet another aspect the grinding portions are formed at the same dimension.

In yet another aspect the grinding portions are formed at the same weight.

In yet another aspect the airflow guiding portion is centered on the top and formed radially therefrom on the dust collection cap in an annular manner.

In yet another aspect the airflow guiding portion is centered on the top and formed helically therefrom on the dust collection cap in an annular manner.

In yet another aspect the top includes a fastening member coupled with the grinding machine tool and an adjustment member hinged on the fastening member to adjust tightness thereof.

The invention thus formed provides many advantages, notably:

Through the airflow guiding portion of the dust collection cap, a great amount of dust generated during grinding at high speed or large area can be guided to the dust discharge port to be discharged. As the dust collection cap is formed in a taper structure, the height of the dust collection chamber also gradually decreases from the top towards the circumferential wall, thus dust can be gathered easier to the airflow guiding portion and discharged through the dust discharge port located at the distal end of the airflow guiding portion. Moreover, during grinding of the grinding machine tool, the fan portion and vanes are driven by the driving motor to rotate like an electric fan, hence a great amount of dust can be blown upwards. Incorporating with the airflow guiding portion and dust collection cap, a great amount of dust generated during grinding at high speed or large area can be easily discharged through the dust discharge port, therefore can resolve the problem of the conventional grinding machine tool that a great amount of dust generated during grinding at high speed or large area cannot be discharged immediately and smoothly.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
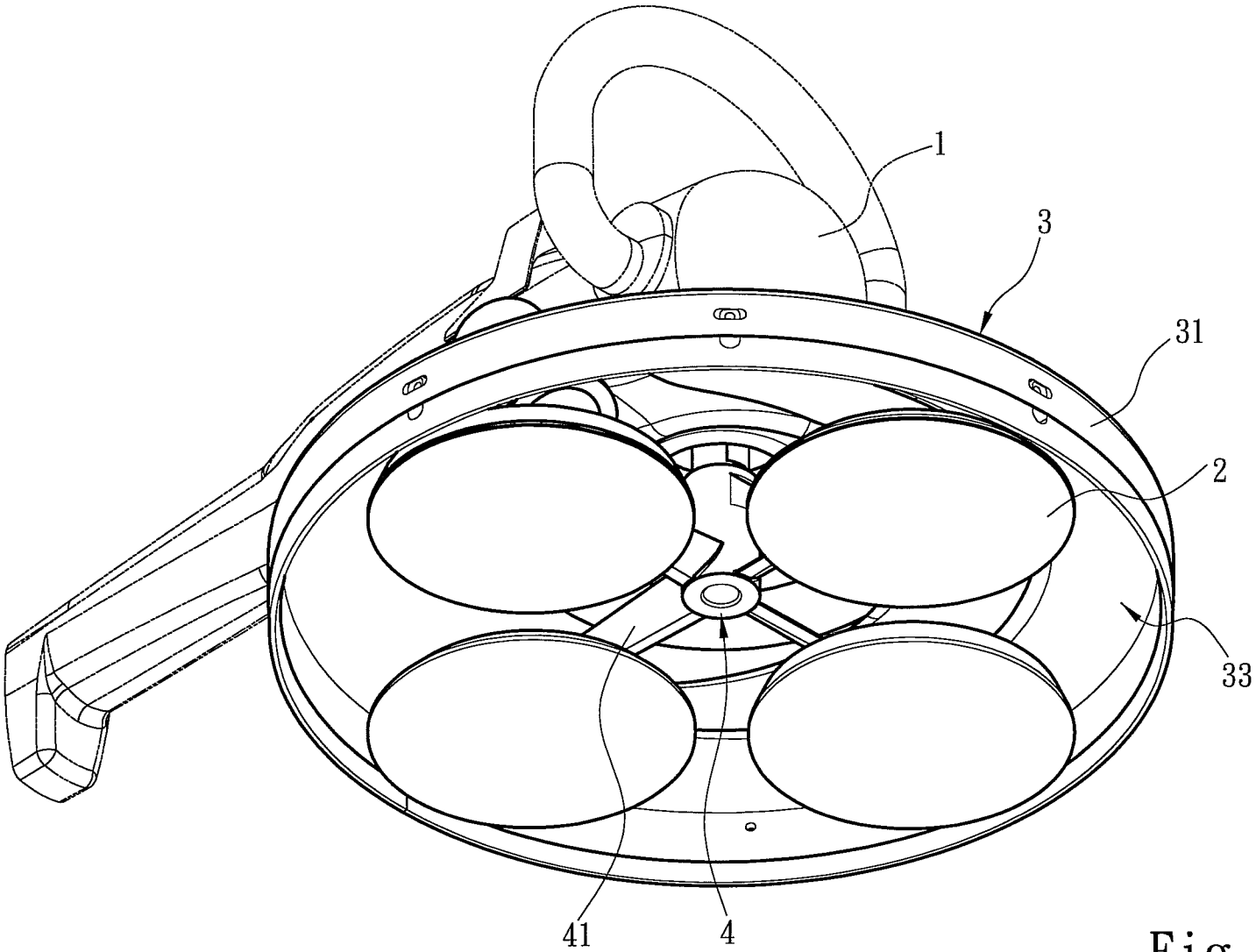
FIG. 1 is a schematic view of the invention showing the dust collection hood of a grinding machine tool in a use condition.
Figure 2:
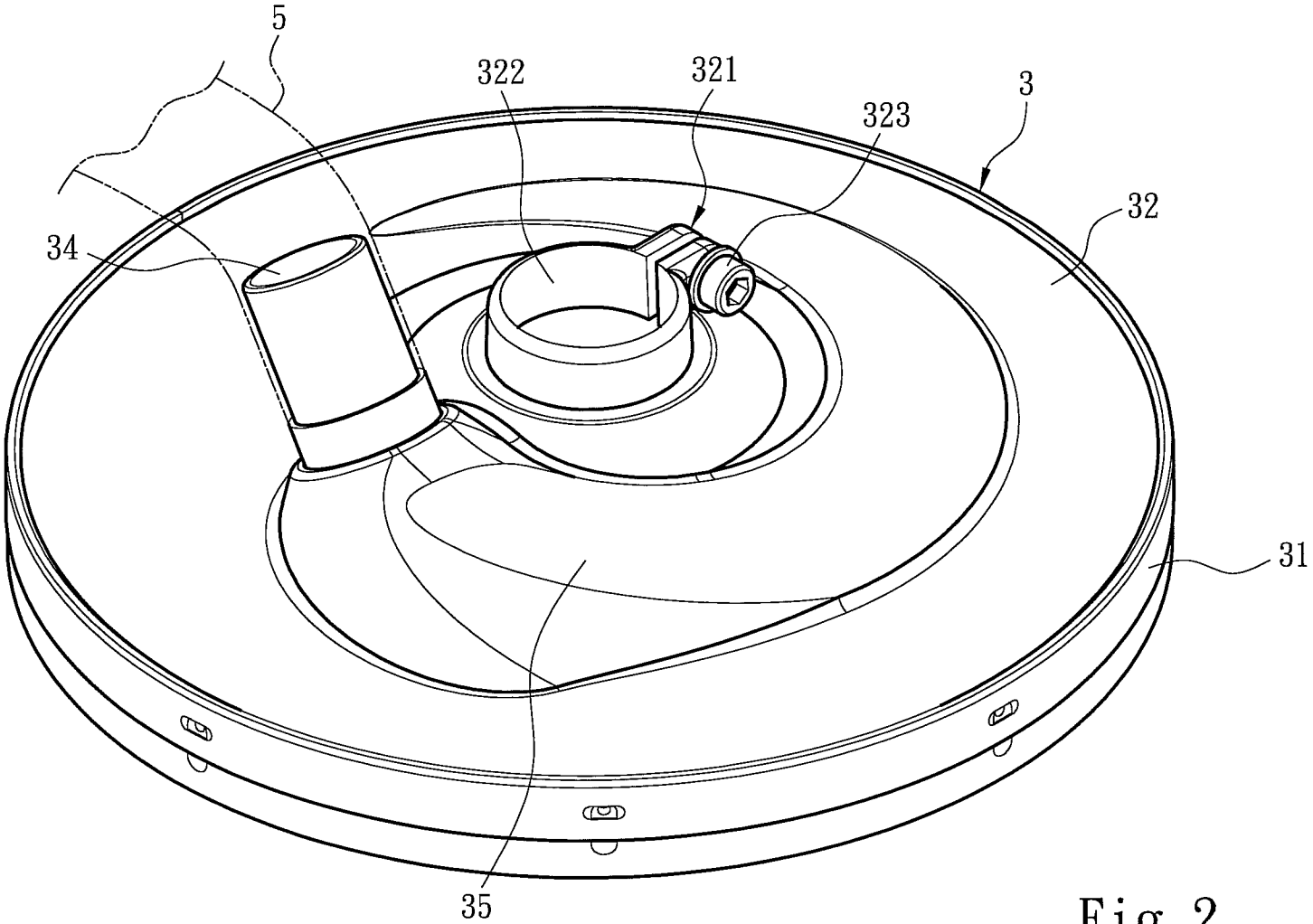
FIG. 2 is a top perspective view of the dust collection hood of the invention.
Figure 3:
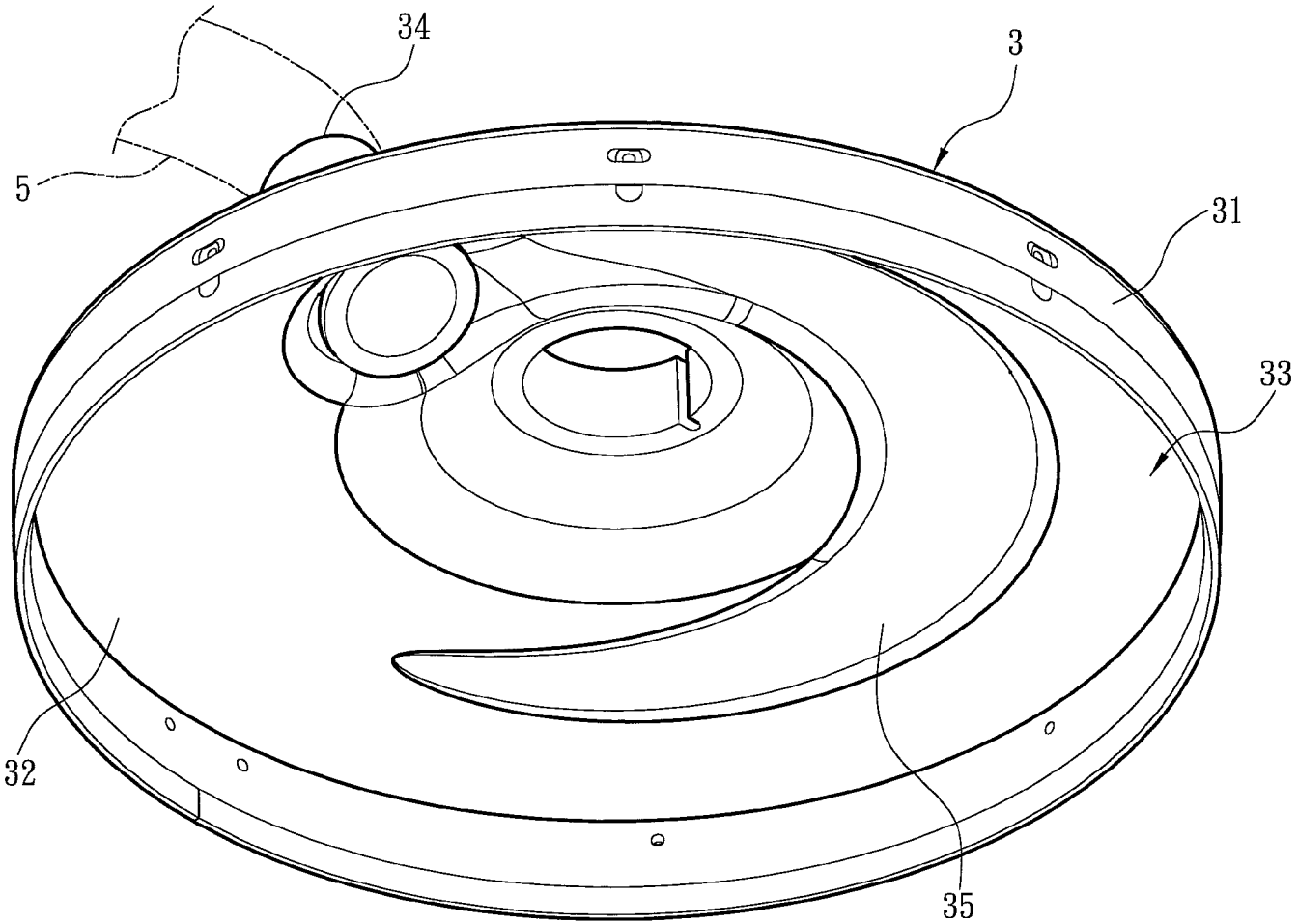
FIG. 3 is a perspective view of the dust collection hood of the invention seen from bottom.

Please referring to FIGS. 1, 2 and 3, the present invention aims to provide a dust collection hood installed on a grinding machine tool. The grinding machine tool includes a driving motor 1 and at least one grinding portion 2 driven by the driving motor 1 to rotate. The dust collection hood 3 includes a circumferential wall 31 surrounding the grinding portion 2 and a dust collection cap 32. The dust collection cap 32 is coupled with the circumferential wall 31 to form a dust collection chamber 33 to house the grinding portion 2. The dust collection cap 32 includes a top 321 fastened to the grinding machine tool. The dust collection chamber 33 is formed at a height gradually decreased from the top 321 towards the circumferential wall 31. The dust collection cap 32 further includes a dust discharge port 34 communicating with the dust collection chamber 33 and an airflow guiding portion 35 to guide airflow from the dust collection chamber 33 to the dust discharge port 34. Thus forms the basic structure of the invention.

The driving motor 1 can be a pneumatic motor or electric motor. The dust discharge port 34 is connected to a dust suction device 5 which allows a great amount of dust to be guided via the airflow guiding portion 35 to the dust discharge port 34. The top 321 also includes a fastening member 322 coupled with the grinding machine tool and an adjustment member 323 hinged on the fastening member 322 to adjust tightness of the fastening member 322. For installation, the dust collection hood 3 is fastened to the grinding machine tool through the fastening member 322. In an embodiment of the invention, the grinding machine tool includes a plurality of grinding portions 2 located at the same horizontal level, and formed at the same size and weight, thereby the grinding portions 2 can rotate smoothly in a balanced manner during grinding of the grinding machine tool. Because the grinding portions 2 are spaced from the center at a distance, the grinding portions 2 can rotate on the track with a greater radius, hence grinding area and grinding force of the grinding machine tool are enhanced. Due to grinding at high speed, a great amount of dust is generated. The grinding machine tool further has a plurality of connecting portions 4 coupled with the grinding portions 2 and a plurality of vanes 41 located on the connecting portions 4. The vanes 41 are driven by the driving motor 1 to rotate during grinding operation like an electric fan to blow the generated dust upwards. The airflow guiding portion 35 is centered on the top 321 and formed radially or helically therefrom on the dust collection cap 32 in an annular manner, but this is not the limitation, any variations or substitutes based on the structure of the invention shall be included in the scope of the invention.

Figure 4:
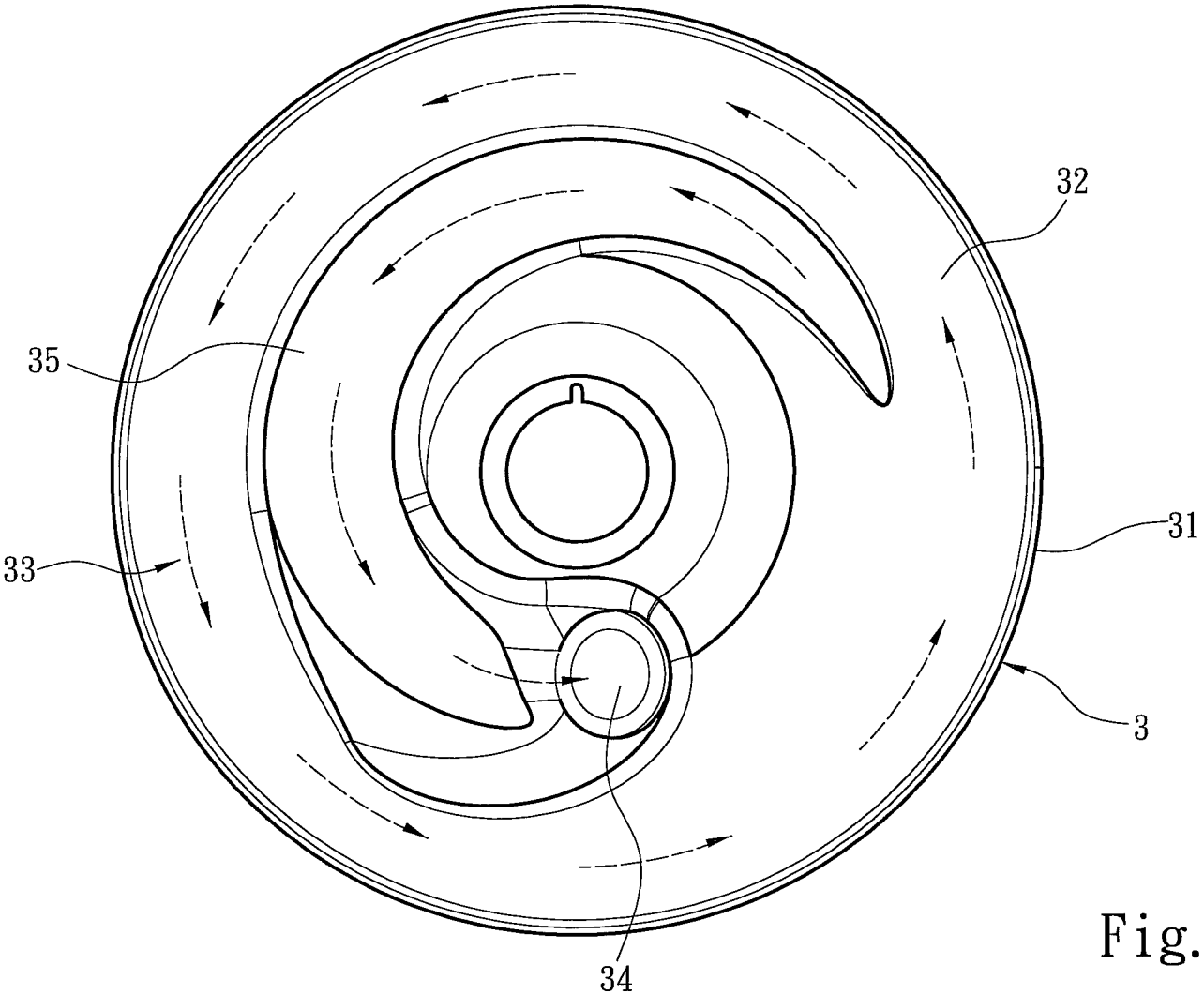
FIG. 4 is a schematic view of the dust collection hood of the invention showing airflow directions.
Figure 5:
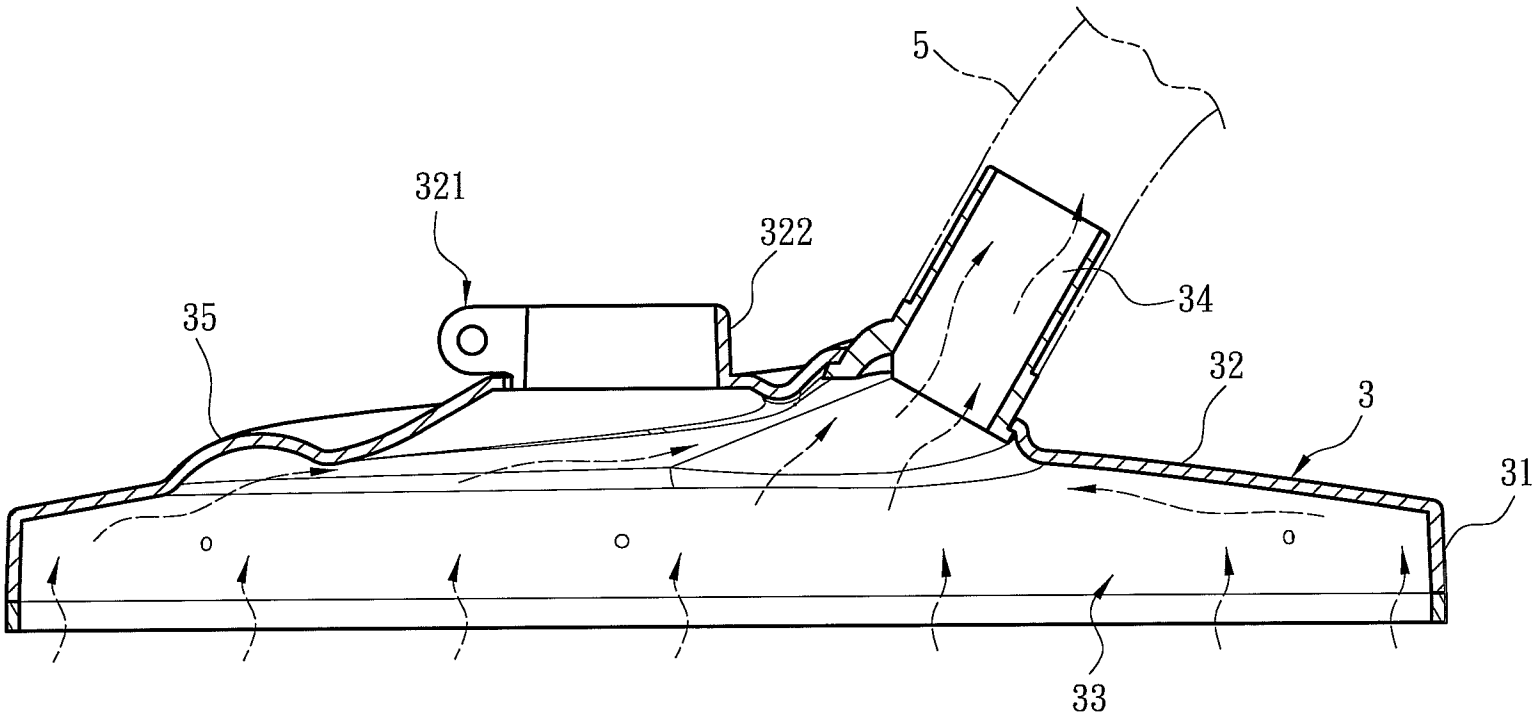
FIG. 5 is a schematic view of the dust collection hood of the invention showing dust expelling condition.

Please refer to FIGS. 4 and 5, when the grinding machine tool of the invention is in use, a great amount of dust is generated during grinding at high speed. The dust is gathered and guided through two slopes: one slope is formed on the dust collection cap 32 from the top 321 to the circumferential wall 31 that can guide swirling and ascending airflow to carry the dust to the center; another is the helical slope that guides the swirling and ascending airflow via the airflow guiding portion 35 from a lower side to carry the dust to a tail end. As the dust discharge port 34 is located at the tail end of the airflow guiding portion 35 and is connected to a dust suction device 5, a great amount of dust can be guided to the dust discharge port 34 through the airflow guiding portion 35 to be discharged by means of the dust suction device 5.

Figure 6:
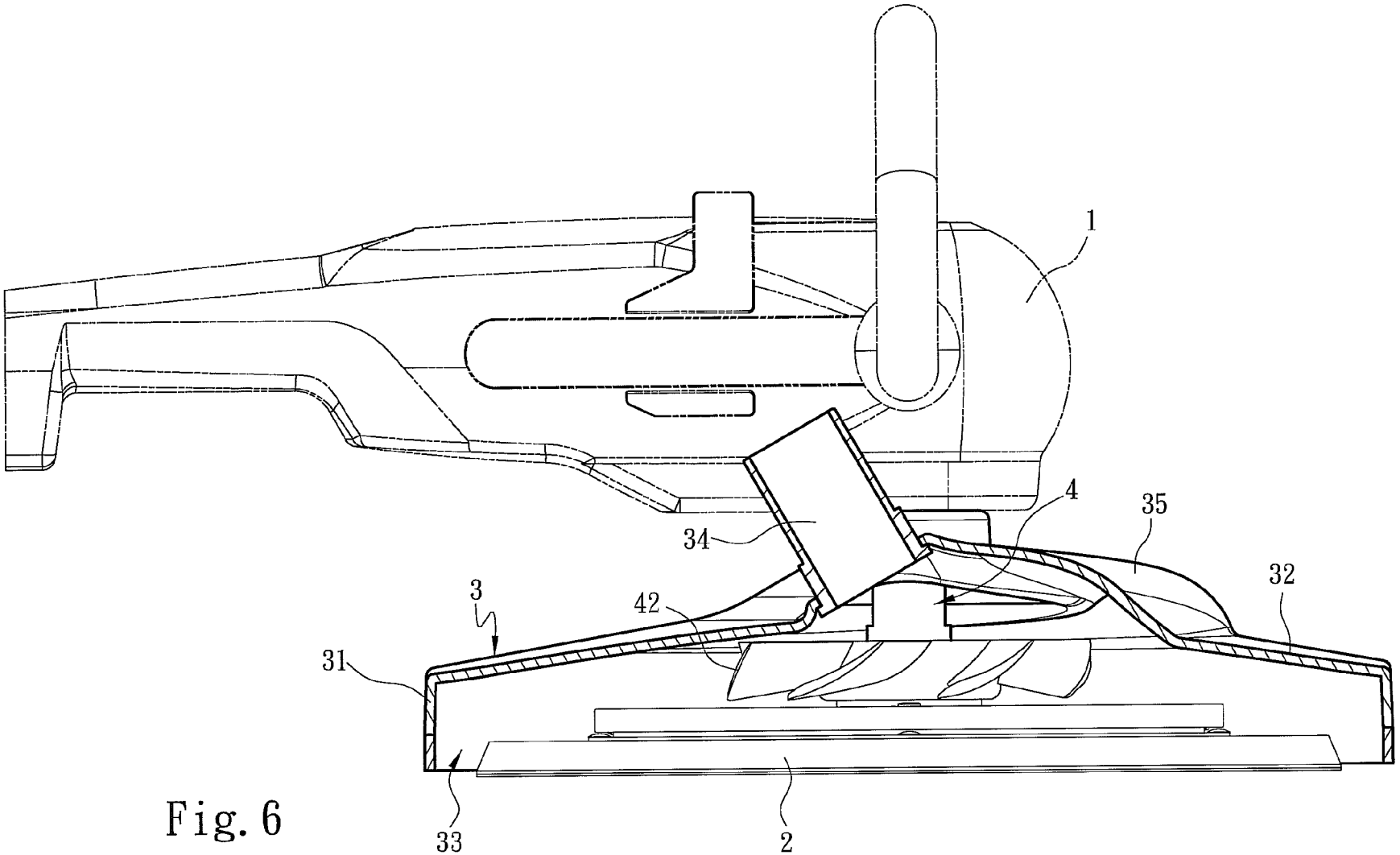
FIG. 6 is a sectional view of another embodiment of the dust collection hood of the invention.

Please refer to FIG. 6 for another embodiment of the dust collection hood of the invention. The grinding machine tool includes a grinding portion 35 with a large area and a fan portion 42 located between the grinding portion 35 and the dust collection cap 32 and coupled with the driving motor 1. When the grinding machine tool performs grinding operation, the driving motor 1 drives the grinding portion 2 and fan portion 42 rotating, and a great amount of dust is generated and gathered through the dust collection hood 3 in the dust collection chamber 33. The fan portion 42 drives airflow in the dust collection chamber 33 to blow the generated dust upwards, and the dust collection cap 32 gathers the airflow to the center to allow the airflow guiding portion 35 to guide the dust towards the dust discharge port 34 to be discharged.

By means of the airflow guiding portion 35 on the dust collection cap 32, during grinding at high speed or large area, a great amount of dust generated by grinding can be gathered via the airflow guiding portion 35 and guided to the dust discharge port 34 to be discharged. As the dust collection cap 32 is formed in a taper structure, the height of the dust collection chamber 33 also decreases from the top 321 to the circumferential wall 31, thus dust can be easily gathered to the airflow guiding portion 35 and further discharged through the dust discharge port 34 at the distal end of the airflow guiding portion 35. Moreover, during grinding of the grinding machine tool, the fan portion 42 and vanes 41 are driven by the driving motor 1 to rotate like an electric fan to blow the dust upwards. Incorporating with the airflow guiding portion 35 and dust collection cap 32, the dust generated during grinding at high speed or large area can be easily and smoothly discharged through the dust discharge port 34. Thus it can overcome the problem of the conventional grinding machine tools that cannot immediately and smoothly discharge a great amount of dust during grinding at high speed or large area.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A grinding machine tool comprising a driving motor, at least one grinding portion driven by the driving motor to rotate, and a dust collection hood for holding the grinding portion, the dust collection hood comprising:

a circumferential wall surrounding the grinding portion; and a dust collection cap which is coupled with the circumferential wall to form a dust collection chamber to house the grinding portion and includes a top, an inclined plane tapered from the circumferential wall to the top, a dust discharge port located on the inclined plane and communicating with the dust collection chamber, and an airflow guiding channel formed on the inclined plane and extended from the dust discharge port toward the circumferential wall, the airflow guiding channel being recessed in a direction remote from the dust collection chamber to guide airflow from the dust collection chamber to the dust discharge port, wherein the airflow guiding portion is centered on the top and formed radially therefrom on the dust collection cap in an annular manner.

2. The grinding machine tool of claim 1, wherein the grinding machine tool includes a plurality of grinding portions at the same horizontal level.

3. The grinding machine tool of claim 2, wherein the grinding machine tool includes a fan portion located between the plurality of grinding portions and the dust collection cap and coupled with the driving motor.

4. The grinding machine tool of claim 2, wherein the grinding machine tool includes a plurality of connecting portions coupled with the plurality of grinding portions and a plurality of vanes located on the plurality of connecting portions.

5. The grinding machine tool of claim 2, wherein the plurality of grinding portions are formed at the same dimension.

6. The grinding machine tool of claim 2, wherein the plurality of grinding portions are formed at the same weight.

7. The grinding machine tool of claim 1, wherein the top includes a fastening member coupled with the grinding machine tool and an adjustment member hinged on the fastening member to adjust tightness of the fastening member.

8. The grinding machine tool of claim 1, wherein the grinding machine tool includes a fan portion located between the grinding portion and the dust collection cap and coupled with the driving motor.

9. A grinding machine tool comprising a driving motor, at least one grinding portion driven by the driving motor to rotate, and a dust collection hood for holding the grinding portion, the dust collection hood comprising:

a circumferential wall surrounding the grinding portion; and a dust collection cap which is coupled with the circumferential wall to form a dust collection chamber to house the grinding portion and includes a top, an inclined plane tapered from the circumferential wall to the top, a dust discharge port located on the inclined plane and communicating with the dust collection chamber, and an airflow guiding channel formed on the inclined plane and extended from the dust discharge port toward the circumferential wall, the airflow guiding channel being recessed in a direction remote from the dust collection chamber to guide airflow from the dust collection chamber to the dust discharge port, wherein the airflow guiding portion is centered on the top and formed helically therefrom on the dust collection cap in an annular manner.

10. The grinding machine tool of claim 9, wherein the grinding machine tool includes a plurality of grinding portions at the same horizontal level.

11. The grinding machine tool of claim 10, wherein the grinding machine tool includes a fan portion located between the plurality of grinding portions and the dust collection cap and coupled with the driving motor.

12. The grinding machine tool of claim 10, wherein the grinding machine tool includes a plurality of connecting portions coupled with the plurality of grinding portions and a plurality of vanes located on the plurality of connecting portions.

13. The grinding machine tool of claim 10, wherein the plurality of grinding portions are formed at the same dimension.

14. The grinding machine tool of claim 10, wherein the plurality of grinding portions are formed at the same weight.

15. The grinding machine tool of claim 9, wherein the top includes a fastening member coupled with the grinding machine tool and an adjustment member hinged on the fastening member to adjust tightness of the fastening member.

16. The grinding machine tool of claim 9, wherein the grinding machine tool includes a fan portion located between the grinding portion and the dust collection cap and coupled with the driving motor.

* * * * *